US007633495B2

(12) United States Patent
Lee et al.

(10) Patent No.: US 7,633,495 B2
(45) Date of Patent: Dec. 15, 2009

(54) DRIVING CIRCUIT WITH LOW POWER CONSUMPTION MULTIPLEXER AND A DISPLAY PANEL AND AN ELECTRONIC DEVICE USING THE SAME

(75) Inventors: Szu-Hsien Lee, Kaohsiung (TW); Norio Oku, Taipei (TW)

(73) Assignee: TPO Displays Corp. (TW)

( * ) Notice: Subject to any disclaimer, the term of this patent is extended or adjusted under 35 U.S.C. 154(b) by 685 days.

(21) Appl. No.: 11/353,840

(22) Filed: Feb. 14, 2006

(65) Prior Publication Data

US 2007/0188523 A1 Aug. 16, 2007

(51) Int. Cl.
*G09G 5/00* (2006.01)

(52) U.S. Cl. ..... 345/204; 345/93; 345/98; 345/100

(58) Field of Classification Search ..... 345/83, 345/87, 93, 98, 100, 204; 349/139
See application file for complete search history.

(56) References Cited

U.S. PATENT DOCUMENTS 6,697,037 B1 * 2/2004 Alt et al. ..... 345/93
7,492,338 B2 * 2/2009 Yamazaki et al. ..... 345/83
2002/0000964 A1 * 1/2002 Sumiya ..... 345/87
2004/0169807 A1 * 9/2004 Rho et al. ..... 349/139

FOREIGN PATENT DOCUMENTS

CN 1426045 6/2003
CN 1617016 5/2005

OTHER PUBLICATIONS

English Abstract of CN1617016.
English Abstract of CN1426045.

* cited by examiner

*Primary Examiner*—Amare Mengistu
*Assistant Examiner*—Premal Patel
(74) *Attorney, Agent, or Firm*—Thomas, Kayden, Horstemeyer & Risley, LLP

(57) ABSTRACT

The invention provides a low power multiplexer configuration in a display panel and a display panel and an electronic device using the same. The multiplexer conducts one of source output signals into to red (or green or blue) sub-pixels under control of control signals. In every time a frame is scanned or changed, the red (or green or blue) sub-pixels driven by the source output signal via the multiplexer are always in the same signal polarity, so the multiplexer consumes low power because voltage swing rates in source output signals are very low or almost zero.

19 Claims, 11 Drawing Sheets

DRIVING CIRCUIT WITH LOW POWER CONSUMPTION MULTIPLEXER AND A DISPLAY PANEL AND AN ELECTRONIC DEVICE USING THE SAME

BACKGROUND OF THE INVENTION

1. Field of Invention

The present invention relates to a display panel system, and more particular to a display panel system with low power consumption multiplexers.

2. Description of Related Art

Rapid development within the fields of information and communication has caused an increase in the demand for thin, lightweight and low cost display devices for viewing information. Industries that develop displays are responding to these needs by placing high emphasis on developing flat panel type displays.

Historically, Cathode Ray Tube (CRT) monitors have been widely used as a display device in applications such as televisions, computer monitors, and the like, because CRT monitors can display under high luminance. However, the CRT monitors cannot adequately satisfy present demands for display applications that require reduced volume and weight, portability, and low power consumption, while having a large screen size and high resolution. Out of this need, the display industry has placed high emphasis on developing flat panel displays to replace the CRT monitors. Over the years, flat panel displays have found wide use in monitors for computers, spacecraft, and aircraft. Examples of flat panel display types currently used include the LCD, the electroluminescent display (ELD), the field emission display (FED), and the plasma display panel (PDP).

Characteristics required for an ideal flat panel display include a lightweight, high luminance, high efficiency, high resolution, high speed response time, low driving voltage, low power consumption, low cost, and natural color.

Development and application of thin film transistor (TFT)-LCD industries have been accelerated in accordance with the increase in the dimensions and increase in the resolution. Many efforts have been made to lower power consumption of the LCD display system.

FIG. 1 shows a simplified block diagram of a display panel system. For example, the display panel is a liquid crystal display (LCD) panel. The display panel system at least includes a display panel 10 and a source driver 15. The display panel 10 at least includes a multiplexer stage 13. The resolution of the display panel 10 is, for example, 320 columns*240 rows. The source driver 15 drives LCD cells on the display panel 10.

FIG. 2 shows a part of the multiplexer stage 13 of FIG. 1. For simplicity, in FIG. 2, only the n-th row (n) is shown. As known, an individual pixel includes three sub-pixels R/G/B. Symbols "R1", "B1", "G1" refer to the three sub-pixels in the first pixel in row(n), "R2", "B2", "G2" refer to the three sub-pixels in the second pixel in row(n) and so on. Signals S(n, 1), S(n, 2), S(n, 3), S(n, 4) and S(n, 5) refer to source output signals from the source driver 15, wherein signal S(n, 1) is coupled to the sub-pixels R1/G1/B1 in the first row(n) via a multiplexer MUX (n, 1), and so on. Each multiplexer includes three transistors. For example, the multiplexer MUX (n, 1) includes transistors Tn,1, Tn,2 and Tn,3; the multiplexer MUX (n, 2) includes transistors Tn,4, Tn,5 and Tn,6 . . . and so on.

Control signals CKH1, CKH2 and CKH3 control on/off states of the transistors in the multiplexer stage 13. The waveforms of the control signals CKH1, CKH2 and CKH3 are shown in the bottom of FIG. 2. When the control signal CKH1 is logic H, the first transistor in each multiplexer is on and accordingly source output signals S(n, 1), S(n, 2), S(n, 3), S(n, 4) and S(n, 5) are directed (or written) into sub-pixels R1, R2, R3 . . . via the ON transistors Tn,1, Tn,4 . . . . Similarly, When the control signal CKH2 is logic H, the second transistor in each multiplexer is on and accordingly source output signals S(n, 1), S(n, 2), S(n, 3), S(n, 4) and S(n, 5) are directed (or written) into sub-pixels G1, G2, G3 . . . via the ON transistors Tn,2, Tn,5 . . . . When the control signal CKH3 is logic H, the third transistor in each multiplexer is on and accordingly source output signals S(n, 1), S(n, 2), S(n, 3), S(n, 4) and S(n, 5) are directed (or written) into sub-pixels B1, B2, B3 . . . via the ON transistors Tn,3, Tn,6 . . . .

The LCD panel display system has four driving modes, i.e., a frame inversion mode, a row inversion mode, a column inversion mode and a dot inversion mode. FIGS. 3*a*~3*d* show the polarity of the source output signals and accordingly the sub-pixels in three consecutive frames under the four driving modes, respectively. Under the four driving modes, every time a frame is changed, the polarity of sub-pixels is changed from positive (+) to negative (−) or from negative (−) to positive (+). In FIGS. 3*a*~3*d*, only three consecutive frames are shown.

As shown in FIG. 3*a*, in the frame inversion mode, the polarity of all sub-pixels in the panel is the same, either positive or negative. If the polarity of all sub-pixels is positive in the first frame, then changed into negative in the second frame, and then changed into positive in the third frame.

As shown in FIG. 3*b*, in the row inversion mode, the polarity of all sub-pixels in the same row is the same (either positive or negative) but is inverted in the next row. For example, in the first frame, the polarity of all sub-pixels in row 1 is positive and the polarity of all sub-pixels in row 2 is negative. When the frame is changed into the second frame, the polarity of all sub-pixels in row 1 is inverted into negative and the polarity of all sub-pixels in row 2 is inverted into positive. When the frame is changed into the third frame, the polarity of all sub-pixels in row 1 is inverted into positive and the polarity of all sub-pixels in row 2 is inverted into negative.

As shown in FIG. 3*c*, in the column inversion mode, the polarity of all sub-pixels in the same column single row is all the same (either positive or negative) but is inverted in the next column. For example, in the first frame, the polarity of all red sub-pixels R1 in the first column are positive, the polarity of all green sub-pixels G1 in the second column are negative, and the polarity of all blue sub-pixels B1 in the third column are positive. When the frame is changed into the second frame and then the third frame, the polarity of all red sub-pixels R1 in the first column is inverted into negative and then positive, the polarity of all green sub-pixels G1 in the second column is inverted into positive and then negative, and the polarity of all blue sub-pixels B1 in the third column is inverted into negative and then positive.

As shown in FIG. 3*d*, in the dot inversion mode, the polarity of any adjacent sub-pixels is different from each other. For example, in the first frame, the polarity of the red sub-pixels R1 in row (1) is positive, but the polarity of its adjacent sub-pixels, the green sub-pixels G1 in row (1) and the polarity of the red sub-pixels R1 in row (2) is both negative. When the frame is changed into the second frame and then the third frame, the polarity of the red sub-pixels R1 in row (1) is inverted into negative and then positive, and the polarity of its adjacent sub-pixels, the green sub-pixels G1 in row (1) and the polarity of the red sub-pixels R1 in row (2) is both inverted into positive and then negative.

For reducing power consumption, the connections between the source output signals and the sub-pixels had better to be optimized. But, in prior art, the connections are not optimized, so the power consumption due to voltage swing and frequency of the source output signals is large, which increase overall power consumption of the display panel system.

FIGS. 4*a*~4*d* show the source output signals of row(n) and row(n+1) under these four driving modes, when the display panel shows a cyan screen. To show a cyan screen, the red sub-pixels are driven high and the green/blue sub-pixels are driven low. In FIGS. 4*a*~4*d*, arrows refer to large voltage swing. Usually, large voltage swing and high swing frequency result in large power consumption. For example, in FIG. 4*a*, because the red sub-pixel R1 is driven positive high and the green sub-pixel G1 is driven positive low, a large voltage swing occurs when the source output signals S(n,1) is changed from positive high to positive low. Furthermore, in the prior art, voltage swing frequency under these four driving modes are high, and accordingly, power consumption of the prior multiplexer is high.

Therefore, a low power consumption multiplexer configuration, which reduced voltage swing rates (signal change rates) is needed for power saving.

SUMMARY OF THE INVENTION

One object of the invention is to provide a low power consumption multiplexer and a display panel apparatus applying the same, wherein in scanning frames, signal frequency changes in source output signals are very low, because sub-pixels coupled to the same multiplexer are always driven in the same signal polarity.

To achieve the above and other objects, a multiplexer configuration in a display panel for driving first, second and third (red, blue or green) sub-pixels of the display panel is provided. The multiplexer includes a first transistor, for coupling a source signal line to drive the first sub-pixel under control of a first control signal; a second transistor, for coupling the source signal line to drive the second sub-pixel under control of a second control signal; and a third transistor, for coupling the source signal line to drive the third sub-pixel under control of a third control signal. The conducting periods of the first, second and third transistors are alternative (non-overlap) and the first, second and third sub-pixels are driven to show the same color (red, blue or green) in the same scan polarity (positive or negative). The first transistor includes a source terminal coupled to the source signal line, a gate terminal coupled to the first control signal and a drain terminal coupled to the first sub-pixel. The second transistor includes a source terminal coupled to the source signal line, a gate terminal coupled to the second control signal and a drain terminal coupled to the second sub-pixel. The third transistor includes a source terminal coupled to the source signal line, a gate terminal coupled to the third control signal and a drain terminal coupled to the third sub-pixel. A display panel and an electronic device using the multiplexer configuration are also provided.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
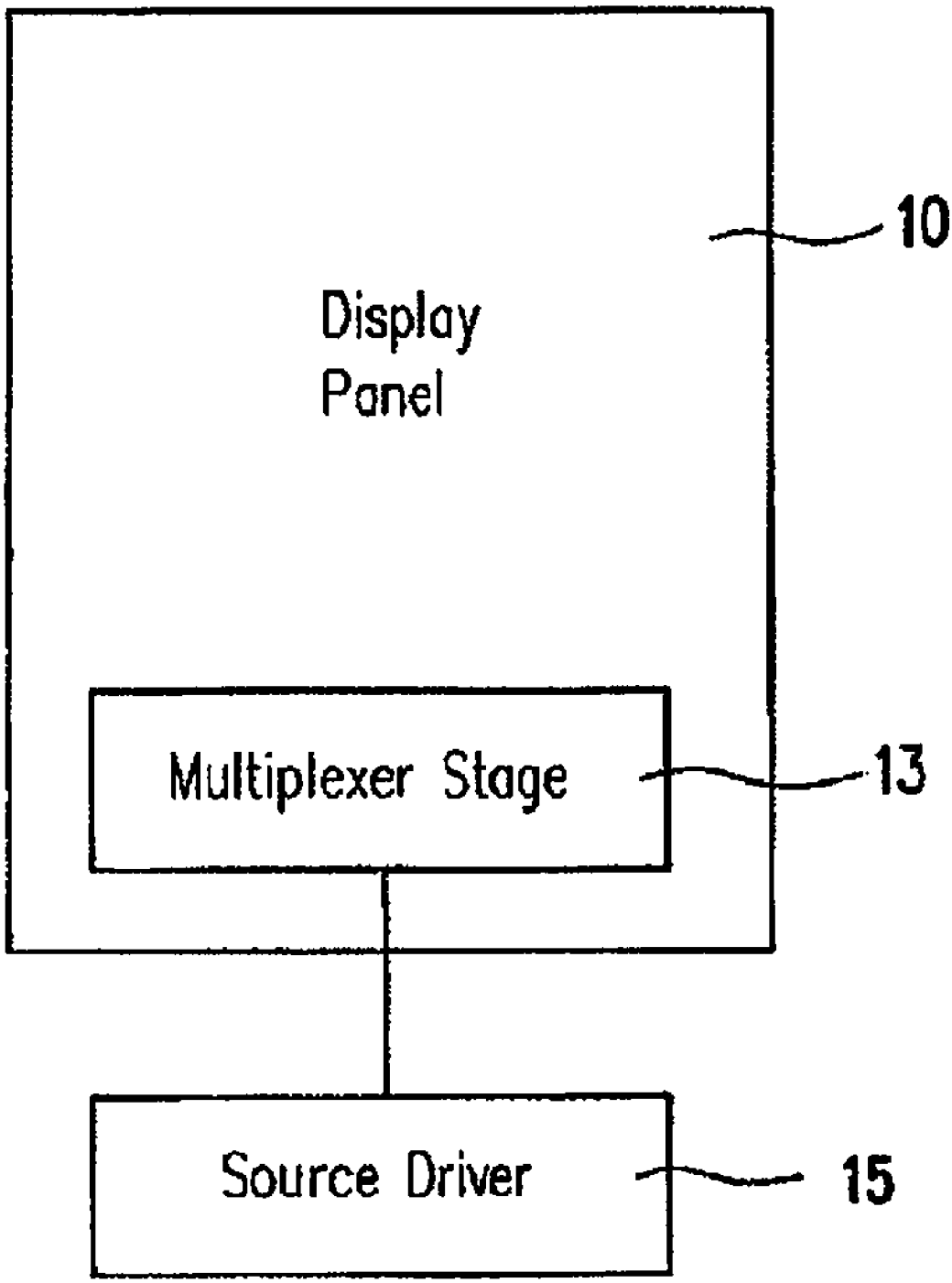
FIG. 1 (PRIOR ART)
FIG. 1 is a simplified block diagram of a conventional display panel system.
Figure 2:
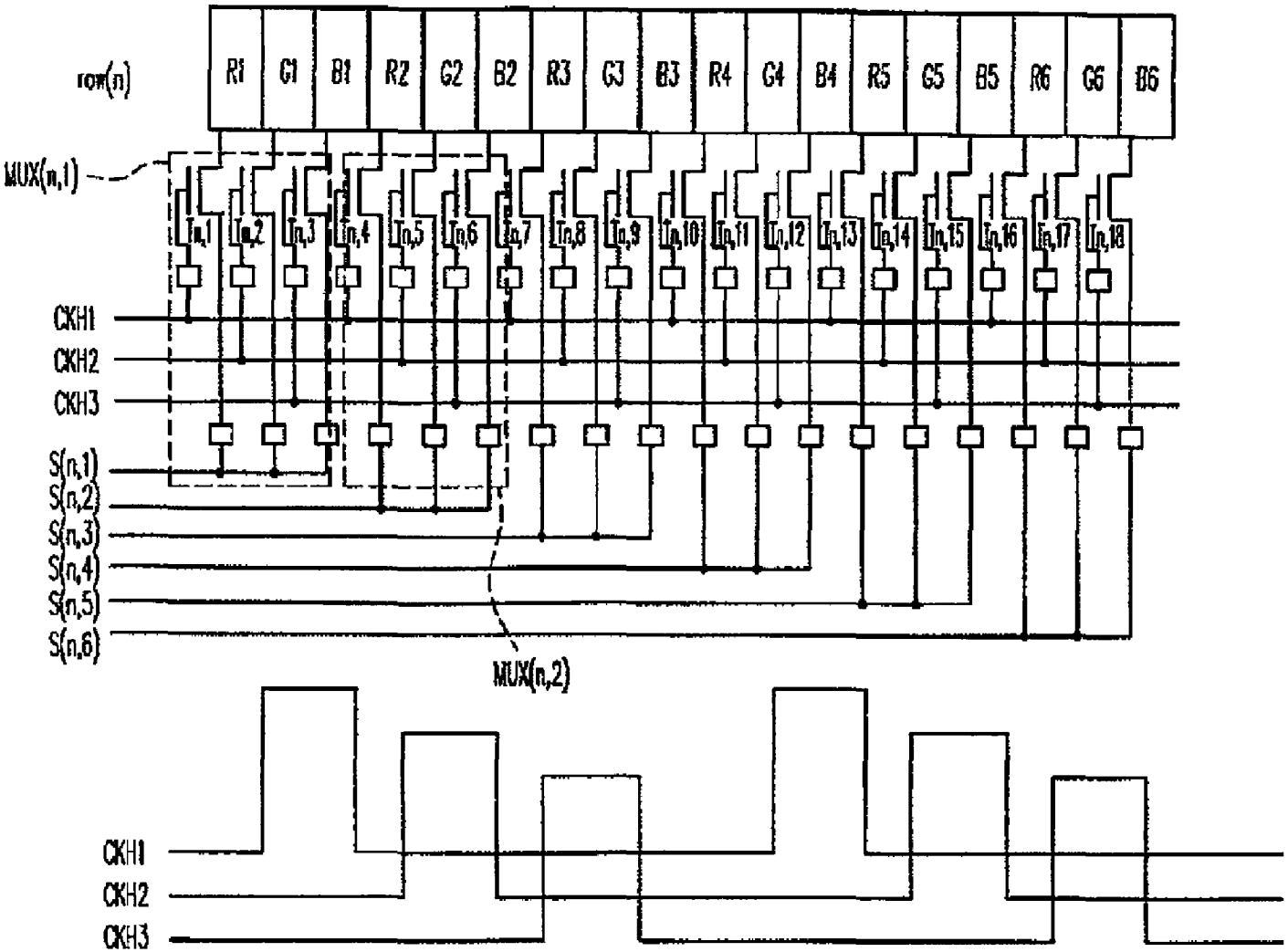
FIG. 2 (PRIOR ART)
FIG. 2 shows connections between source output signals and sub-pixels and the configuration of a conventional multiplexer stage.

Reference will now be made in detail to the present embodiments of the invention, examples of which are illustrated in the accompanying drawings. Wherever possible, the same reference numbers are used in the drawings and the description to refer to the same or like parts.

In general, gray scales of adjacent sub-pixel or pixels in a display panel are not much different from each other. For example, gray scale of a red sub-pixel R1 in row (1) may be 63 and that of another red sub-pixel R1 in row (2) may be 60. Besides, occurrence of voltage swings are often due to polarity change of source output signals or sub-pixels. So, to effectively reduce polarity change rate of source output signals applied to adjacent sub-pixels will effectively reduce voltage swing rates.

Figure 5:
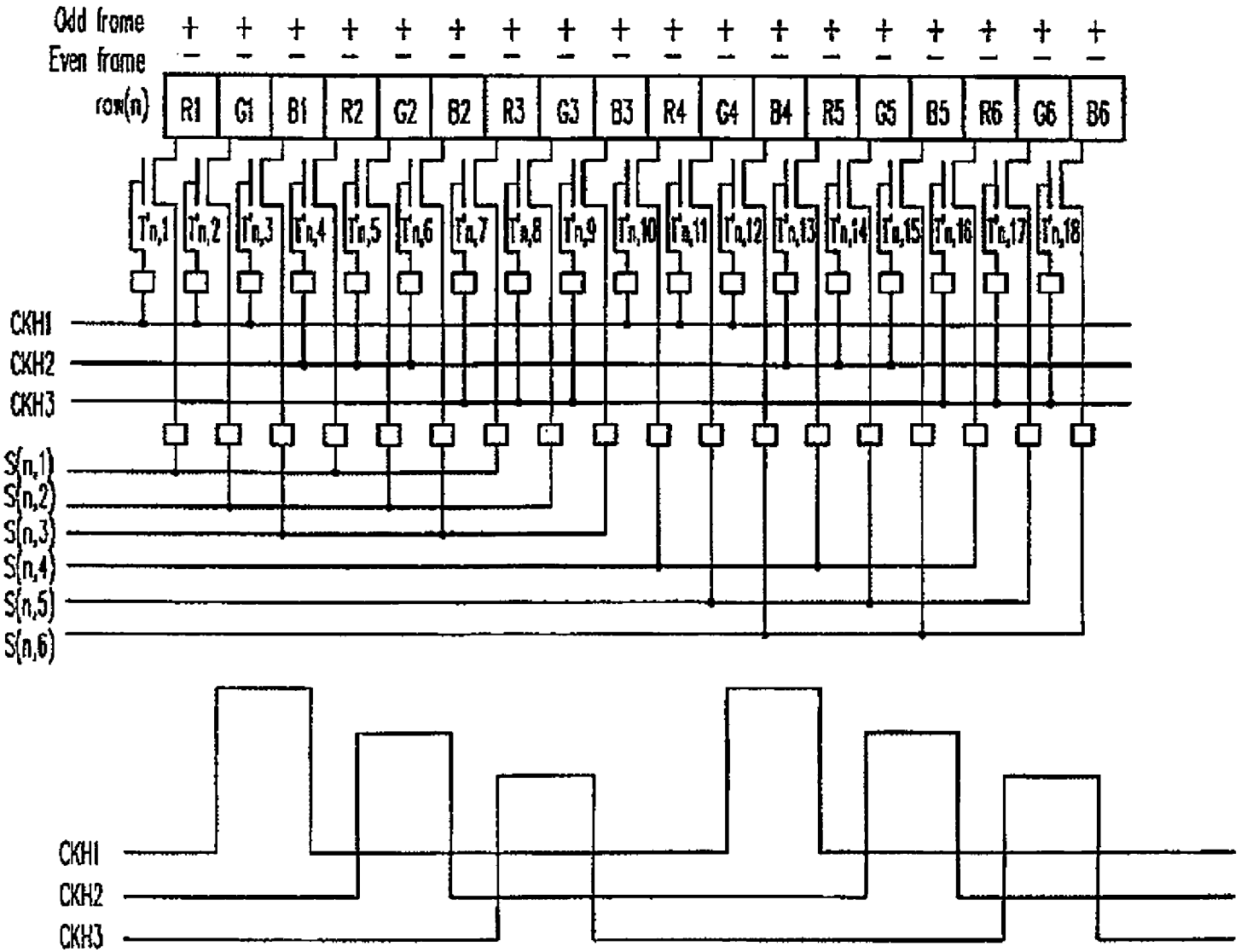
FIG. 5 shows connections between source output signals and sub-pixels and the configuration of a multiplexer stage according to a first embodiment of the invention.

FIG. 5 shows connections between source output signals and sub-pixels and the configuration of a multiplexer stage in a display panel system according to a first embodiment of the invention. The display panel system includes a display panel and a source driving circuit. The display panel at includes a multiplexer stage. The multiplexer stage includes a plurality of multiplexers, and each multiplexer includes several transistors, for example, three transistors. If the multiplexer includes 3 transistors, which couple one source output signal to three sub-pixels, then the multiplexer is a 1-to-3 multiplexer. Similarly, if the multiplexer includes 6 transistors, which couple one source output signal to six sub-pixels, then the multiplexer is a 1-to-6 multiplexer.

Now referring to FIG. 5, source output signals S (n, 1), S (n, 2), S (n, 3), S (n, 4), S (n, 5) and S (n, 6) . . . are output from the source driving circuit (not shown) of the display panel system. The source output signals S (n, 1), S (n, 2), S (n, 3), S (n, 4), S (n, 5) and S (n, 6) are input into source terminals of the transistors in the multiplexers. For example, the source output signal S (n, 1) is coupled to source terminals of transistors T'n,1, T'n,4 and T'n,7; the source output signal S (n, 2) is coupled to source terminals of transistors T'n,2, T'n,5 and T'n,8; and the source output signal S (n, 3) is coupled to source terminals of transistors T'n,3, T'n,6 and T'n,9.

In FIG. 5, a first multiplexer includes three transistors T'n,1, T'n,4 and T'n,7. Similarly, a second multiplexer includes three transistors T'n,2, T'n,5 and T'n,8; a third multiplexer includes three transistors T'n,3, T'n,6 and T'n,9; a fourth multiplexer includes three transistors T'n,10, T'n,13 and T'n,16; a fifth multiplexer includes three transistors T'n,11, T'n,14 and T'n,17; and a sixth multiplexer includes three transistors T'n,12, T'n,15 and T'n,18.

A control signal CKH1 is coupled into gate terminals of transistors T'n,1, T'n,2, T'n,3, T'n,10, T'n,11 and T'n,12. Similarly, a control signal CKH2 is coupled into gate terminals of transistors T'n,4, T'n,5 and T'n,6, T'n,13, T'n,14 and T'n,15; and a control signal CKH3 is coupled into gate terminals of transistors T'n,7, T'n,8 and T'n,9, T'n,16, T'n,17 and T'n,18. Control signals CKH1~CKH3 are used to control on/off states of the corresponding transistors. Conducting periods of the control signals CKH1~CKH3 are alternative. When the control signal is logic high, the corresponding transistors are on, and the source output signals are coupled or written into the corresponding sub-pixels. Waveforms of the control signals CKH1~CKH3 are shown in bottom of FIG. 5. Drain terminals of the transistors are coupled to sub-pixels. Drain terminals of the transistors T'n,1, T'n,2 and T'n,3 are coupled to sub-pixels R1, G1 and B1, respectively and so on. In FIG. 5, symbols "+" and "−" mean signal polarity of the sub-pixels under frame inversion and row inversion modes. Transistors T'n,10~T'n,18 have the same or similar configurations to the transistors T'n,1~T'n,9 and the detail description is omitted for simplicity.

When the control signal CKH1 is logic high, transistors T'n,1~T'n,3 and T'n,10~T'n,12 are on. Accordingly, source output signals S(n,1), S(n,2), S(n,3), S(n,4), S(n,5) and S(n,6) are coupled into the sub-pixels R1, G1, B1, R4, G4 and B4, respectively. Similarly, when the control signal CKH2 is logic high, transistors T'n,4~T'n,6 and T'n,13~T'n,15 are on. Accordingly, source output signals S(n,1) S(n,2), S(n,3), S(n,4), S(n,5) and S(n,6) are coupled into the sub-pixels R2, G2, B2, R5, G5 and B5, respectively. When the control signal CKH3 is logic high, transistors T'n,7~T'n,9 and T'n,16~T'n,18 are on. Accordingly, source output signals S(n,1) S(n,2), S(n,3), S(n,4), S(n,5) and S(n,6) are coupled into the sub-pixels R3, G3, B3, R6, G6 and B6, respectively.

Figure 6A:
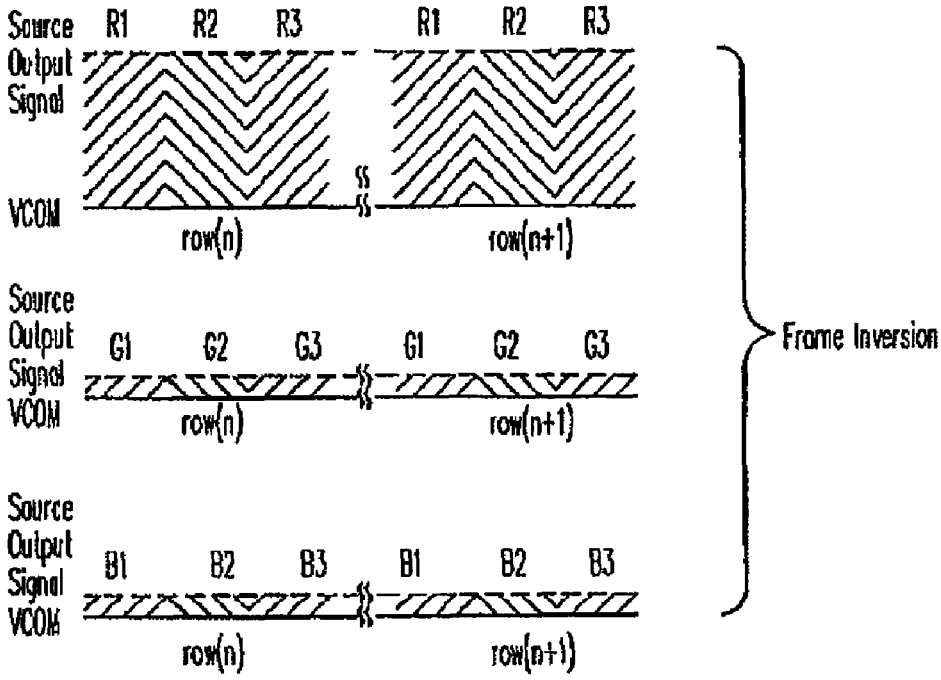
FIGS. 6*a* and 6*b* show waveforms of the source output signals under frame inversion and row inversion modes, when a cyan screen is shown on the display panel system according to the first embodiment of the present invention.
Figure 6B:
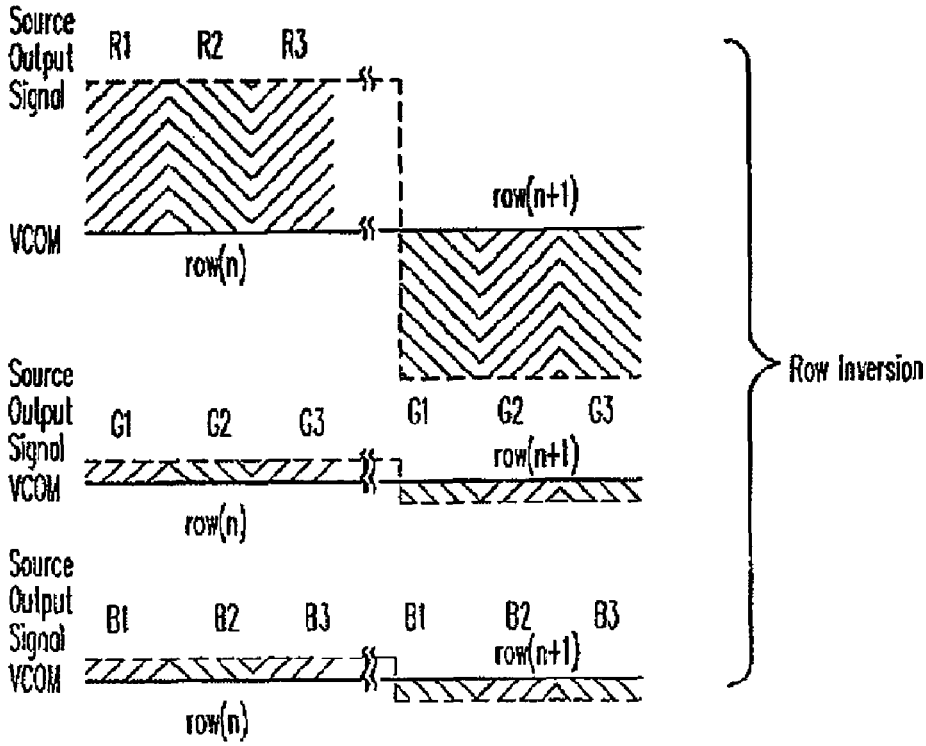

FIGS. 6*a* and 6*b* show waveforms of the source output signals under frame inversion and row inversion modes, for example, when a cyan screen is shown on the display panel system according to the first embodiment of the present invention. To display a cyan color, the red-pixels are driven positive or negative high, and green and blue sub-pixels are driven positive or negative low.

Figure 3A:
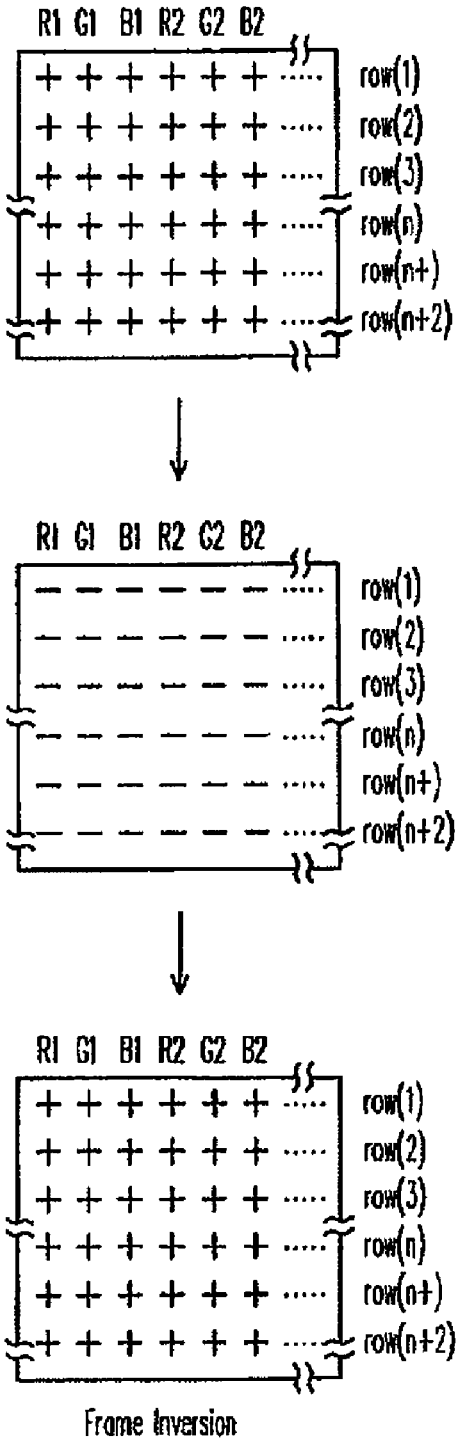
FIG. 3a (PRIOR ART)
FIGS. 3*a*~3*d* show polarity of sub-pixels under four driving modes.

FIG. 6*a* shows waveforms of source output signals applied to first three pixels in row (n) and row (n+1) under the frame inversion mode. "VCOM" refers to a reference voltage, for example, 0V. Please referring back to FIG. 3*a*, under the frame inversion mode, the polarity of sub-pixels R1/R2/R3 (and their corresponding source output signals) in each pixel row are always the same in every frame. Therefore, there is no or only small voltage swing in the source output signal S (n, 1) because the source output signal S (n, 1) are maintained in the same polarity in driving the red sub-pixels. Similarly, there is no or only small voltage swing in the source output signals S (n, 2), S (n, 3) . . . .

Figure 4A:
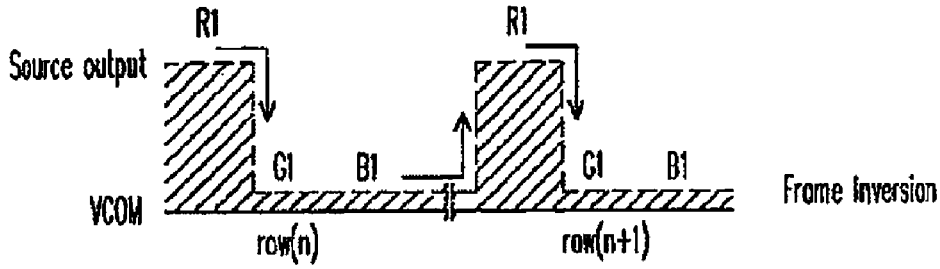
FIG. 4a (PRIOR ART)
FIGS. 4*a*~4*d* show voltage swings of the source output signals under the four driving modes, when the conventional display panel shows a cyan screen.

In the prior art as shown in FIG. 4*a* under the frame inversion mode, voltage swing occurs when the source output signal of a positive high for driving R1 is changed into source output signal of a positive low for driving G1.

Figure 3B:
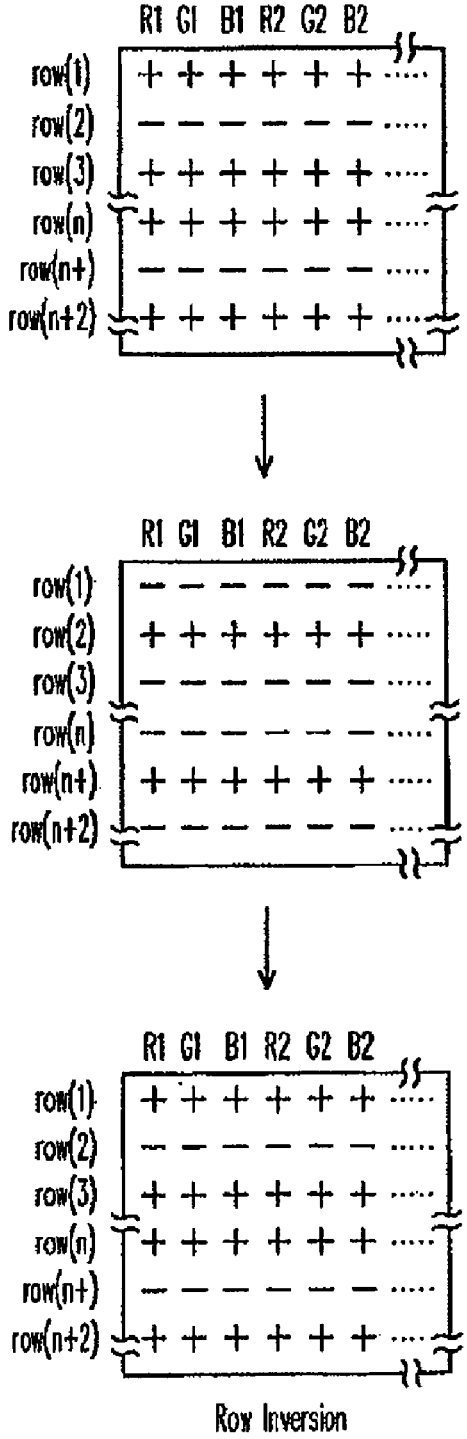
FIG. 3b (PRIOR ART)

FIG. 6*b* shows waveforms of source output signals applied to first three pixels in row (n) and row (n+1) under the row inversion mode. Please referring back to FIG. 3*b*, under the row inversion mode, the polarity of red sub-pixels R1/R2/R3 (and their corresponding source output signals) in one single row are always the same but inverted in the next row in every frame. Therefore, there is no or only small voltage swing in the source output signal S (n, 1) because the source output signal S (n, 1) are maintained in the same polarity in driving the red sub-pixels R1/R2/R3. But a voltage swing occurs in driving an inverted polarity of red sub-pixels in the next row (n+1). Similarly, there is no or only small voltage swing in the source output signals S (n, 2), S (n, 3) . . . .

Figure 4B:
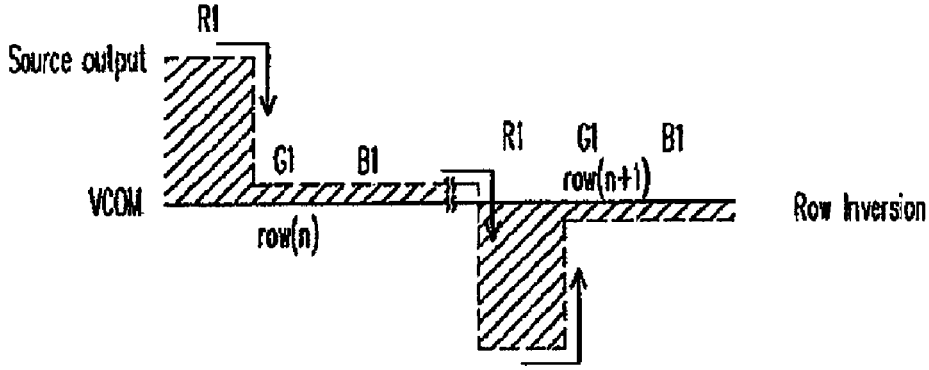
FIG. 4b (PRIOR ART)

In the prior art as shown in FIG. 4*b* under the frame inversion mode, voltage swing occurs when the source output signal of a positive high for driving R1 is changed into source output signal of a positive low for driving G1 or when the source output signal of a negative high for driving R1 is changed into source output signal of a negative low for driving G1.

As discussed above, compared to voltage swing rates and power consumption in prior art, the first embodiment of the invention has good performance in low power consumption.

Figure 7:
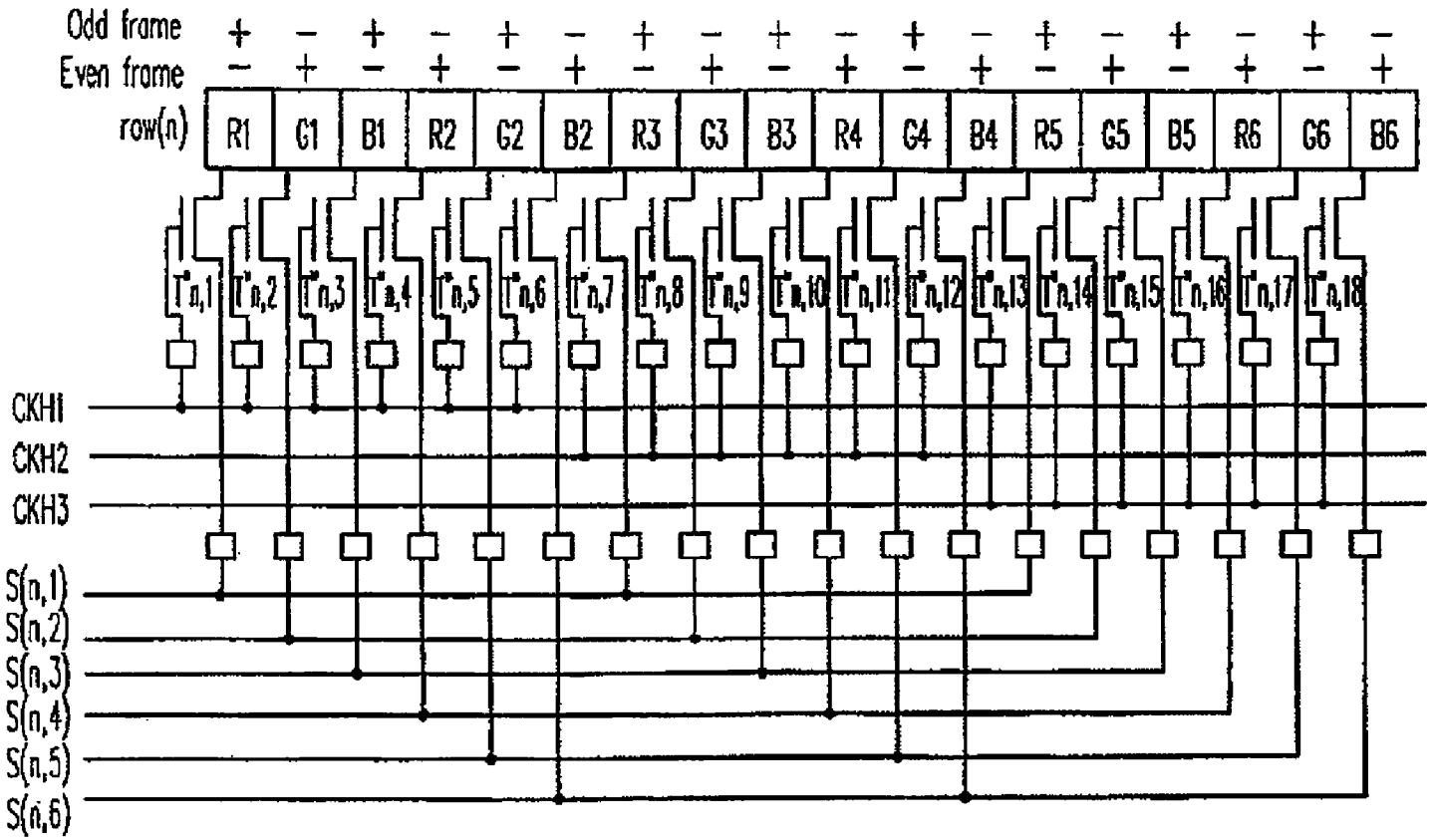
FIG. 7 shows connections between source output signals and sub-pixels and the configuration of a multiplexer stage according to a second embodiment of the invention.
Figure 8A:
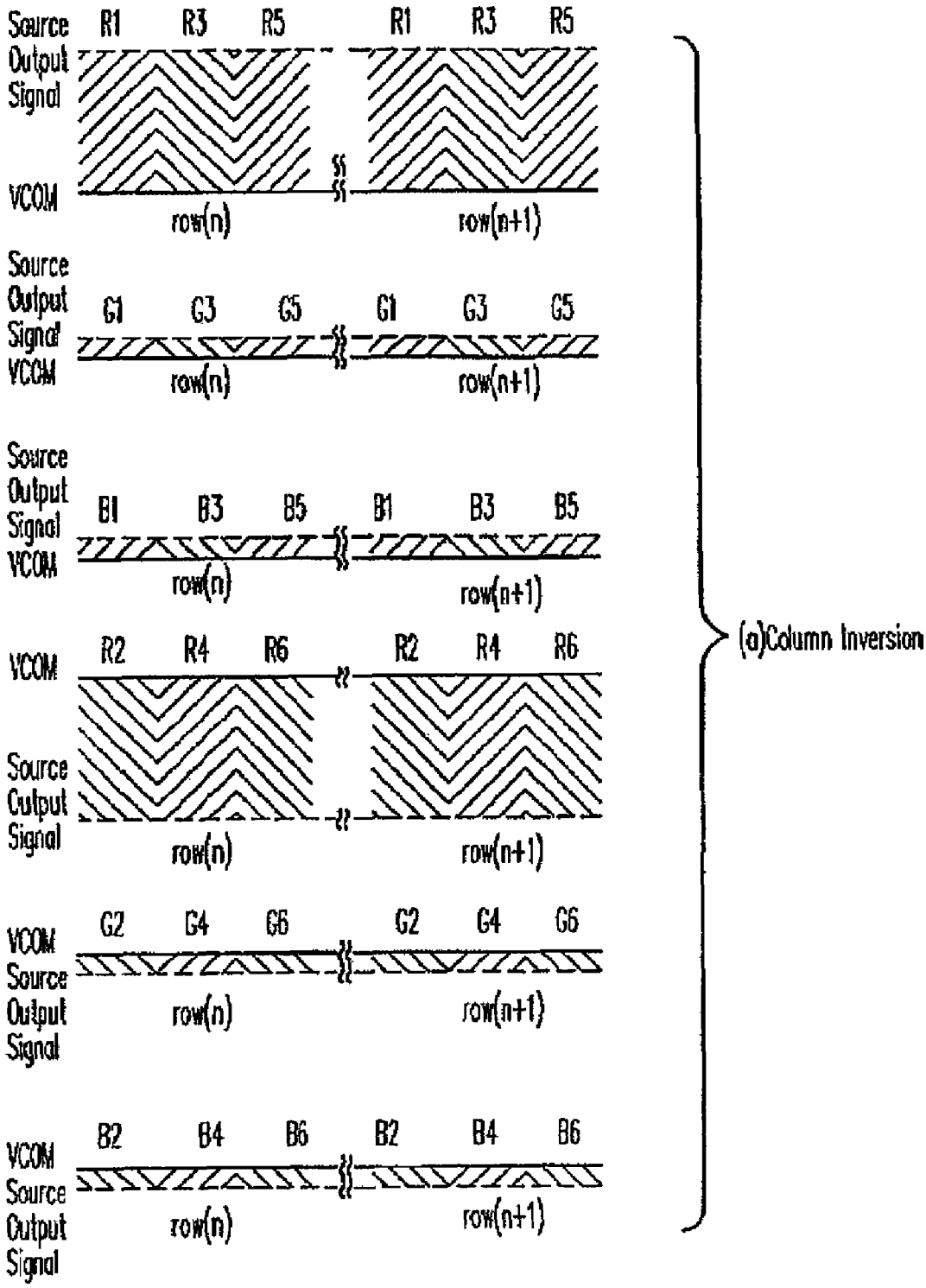
FIGS. 8*a* and 8*b* show waveforms of the source output signals under column inversion and dot inversion modes, when a cyan screen is shown on a display panel system according to the second embodiment of the present invention.
Figure 8B:
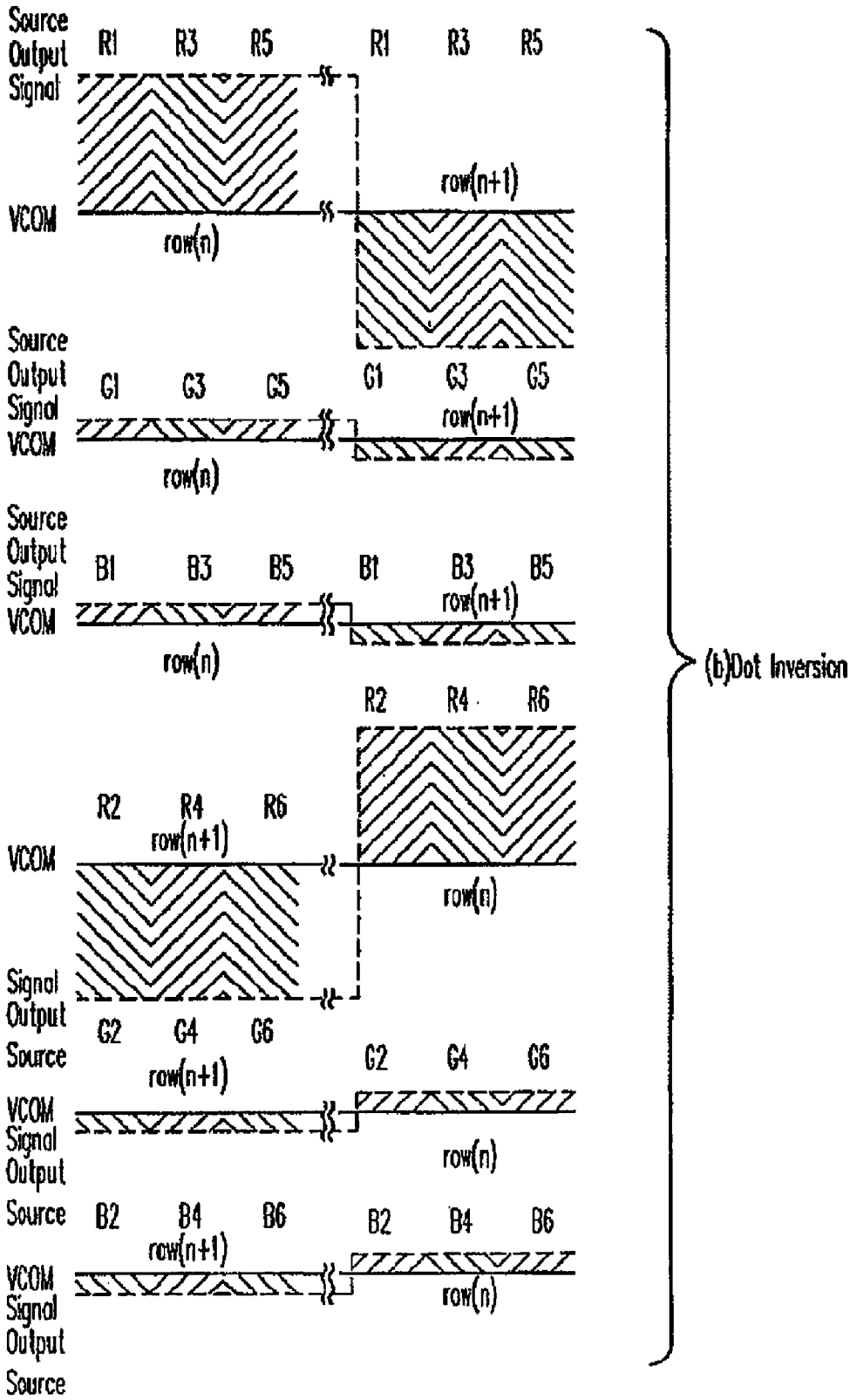

FIG. 7 shows connections between source output signals and sub-pixels and the configuration of a multiplexer stage according to a second embodiment of the invention. FIGS. 8*a* and 8*b* show waveforms of the source output signals under column inversion and dot inversion modes, when a cyan screen is shown on a display panel system according to the second embodiment of the present invention.

Now referring to FIG. 7, source output signals S (n, 1), S (n, 2), S (n, 3), S (n, 4), S (n, 5) and S (n, 6) are input into source terminals of the transistors in the multiplexers. For example, the source output signal S (n, 1) is coupled to source terminals of transistors T"n,1, T"n,7 and T"n,13; the source output signal S (n, 2) is coupled to source terminals of transistors T"n,2, T"n,8 and T"n,14; the source output signal S (n, 3) is coupled to source terminals of transistors T"n,3, T"n,9 and T"n,15, and so on.

A control signal CKH1 is coupled into gate terminals of transistors T"n,1~T"n,6. Similarly, a control signal CKH2 is coupled into gate terminals of transistors T"n,7~T"n,12; and a control signal CKH3 is coupled into gate terminals of transistors T"n,13~T"n,18. Control signals CKH1~CKH3 are used to control on/off states of the corresponding transistors. When control signal is logic high, the corresponding transistors are on, and the source output signals are coupled or written into the corresponding sub-pixels. Waveforms of the control signals CKH1~CKH3 are similar to those in bottom of FIG. 5. Drain terminals of the transistors T"n,1~T"n,6 are coupled to sub-pixels R1, G1, B1, R2, G2 and B2, respectively. Drain terminals of the transistors T"n,7~T"n,12 are coupled to sub-pixels R3, G3, B3, R4, G4 and B4, respectively. Drain terminals of the transistors T"n,13~T"n,18 are coupled to sub-pixels R5, G5, B5, R6, G6 and B6, respectively.

In FIG. 7, symbols "+" and "−" refer to signal polarity of the sub-pixels under dot inversion and column inversion modes. In FIG. 7, a first multiplexer includes three transistors T"n,1, T"n,7 and T"n,13. Similarly, a second multiplexer includes three transistors T"n,2, T"n,8 and T"n,14; a third multiplexer includes three transistors T"n,3, T"n,9 and T"n,15; a fourth multiplexer includes three transistors T"n,4, T"n,10 and T"n,16; a fifth multiplexer includes three transistors T"n,5, T"n,11 and T"n,17; and a sixth multiplexer includes three transistors T"n,6, T"n,12 and T"n,18.

When the control signal CKH1 is logic high, transistors T"n,1~T"n,6 are all on. Accordingly, source output signals S (n, 1), S (n, 2), S (n, 3), S (n, 4), S (n, 5) and S (n, 6) are coupled into the sub-pixels R1, G1, B1, R2, G2 and B2, respectively. When the control signal CKH2 is logic high, transistors T"n, 7~T"n,12 are all on. Accordingly, source output signals S (n, 1), S (n, 2), S (n, 3), S (n, 4), S (n, 5) and S (n, 6) are coupled into the sub-pixels R3, G3, B3, R4, G4 and B4, respectively. When the control signal CKH3 is logic high, transistors T"n, 13~T"n,18 are all on. Accordingly, source output signals S (n, 1), S (n, 2), S (n, 3), S (n, 4), S (n, 5) and S (n, 6) are coupled into the sub-pixel R5, G5, B5, R6, G6 and B6, respectively.

FIGS. 8*a* and 8*b* show waveforms of the source output signals under column inversion and dot inversion modes, for example, when a cyan screen is shown on the display panel system according to the first embodiment of the present invention. To display a cyan color, the red-pixels are driven positive or negative high, and green and blue sub-pixels are driven positive or negative low.

Figure 3C:
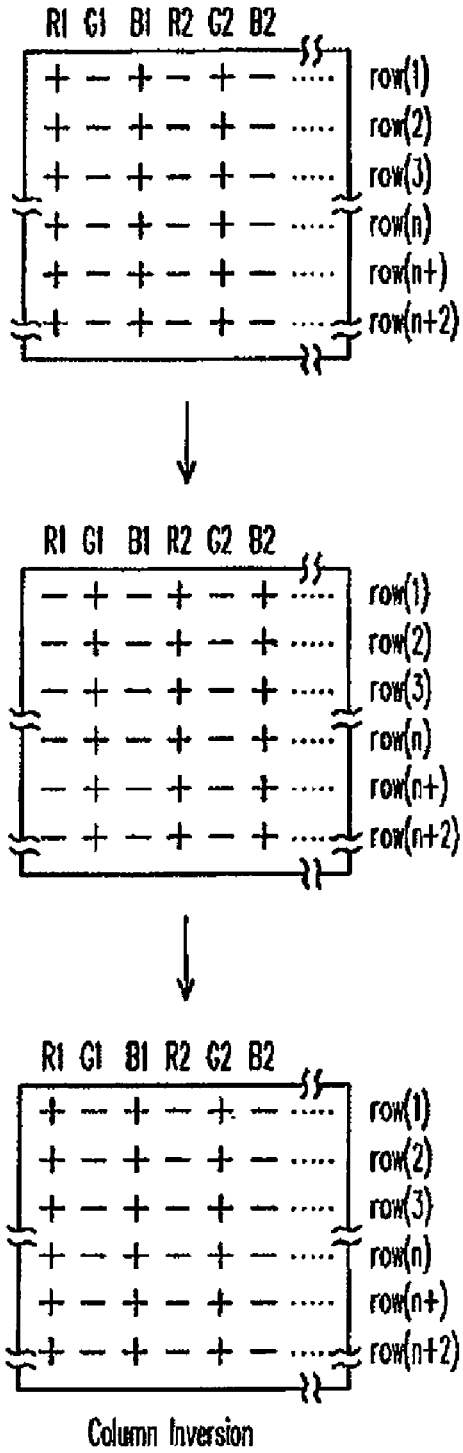
FIG. 3c (PRIOR ART)

FIG. 8*a* shows waveforms of source output signals applied to first three odd pixels in row (n) and row (n+1) under the column inversion mode. Please referring back to FIG. 3*c*, under the column inversion mode, the polarity of sub-pixels (and their corresponding source output signals) in each column is the same in a frame but inverted in a consecutive frame. Therefore, under the column inversion mode, there is no or only small voltage swing in the source output signal S (n, 1) because the source output signal S (n, 1) is maintained in the same polarity in driving the red sub-pixels R1/R3/R5. Similarly, there is no or only small voltage swing in the source output signals S (n, 2), S (n, 3) . . . which drive the green and blue sub-pixels G1/G3/G5 and B1/B3/B5.

Figure 4C:
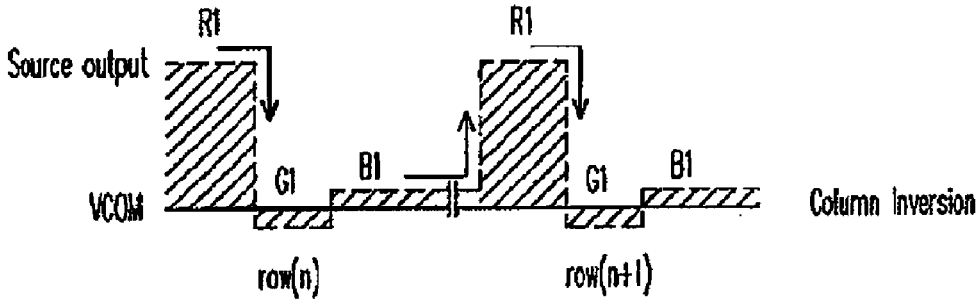
FIG. 4c (PRIOR ART)

In the prior art as shown in FIG. 4*c* under the column inversion mode, voltage swing occurs when the source output signal of a positive high for driving R1 is changed into source output signal of a positive low for driving G1.

Figure 3D:
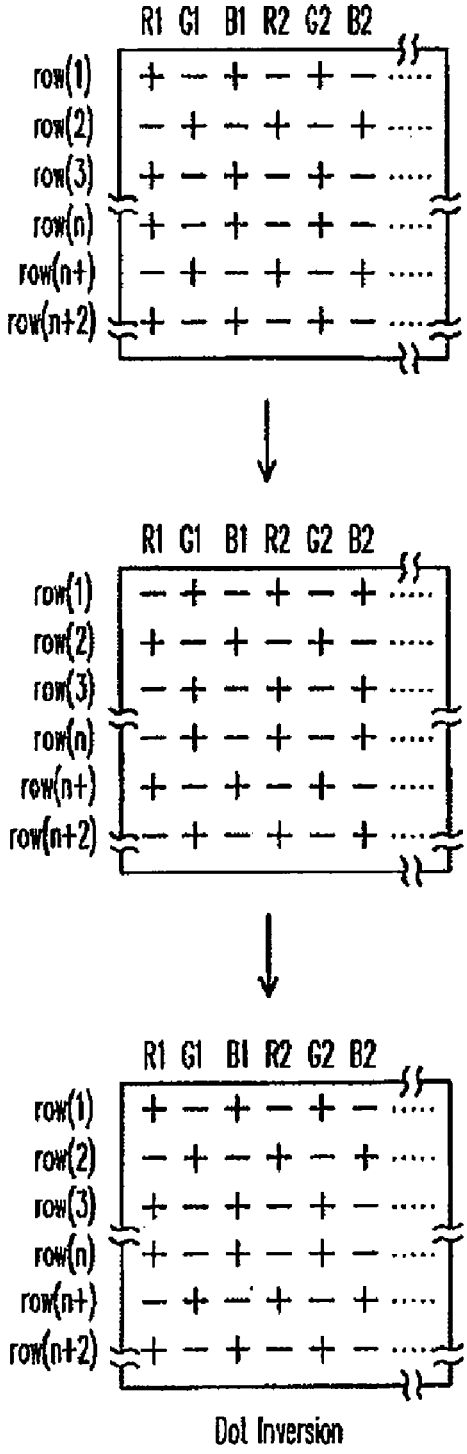
FIG. 3d (PRIOR ART)

FIG. 8*b* shows waveforms of source output signals applied to first three odd pixels in row (n) and row (n+1) under the dot inversion mode. Please referring back to FIG. 3*d*, under the dot inversion mode, the polarity of sub-pixels R1/B1/G2/R3/B3/G4 (and their corresponding source output signals) in one single row is the same but inverted in the next row. Therefore, there is small voltage swing in the source output signal S (n, 1) because the source output signal S (n, 1) is in the same polarity in driving the red sub-pixels R1/R3/R5 of row (n) but inverted in driving the red sub-pixels R1/R3/R5 of row (n+1). Similarly, there is only small voltage swing in the source output signals S (n, 2), S (n, 3) . . . .

Figure 4D:
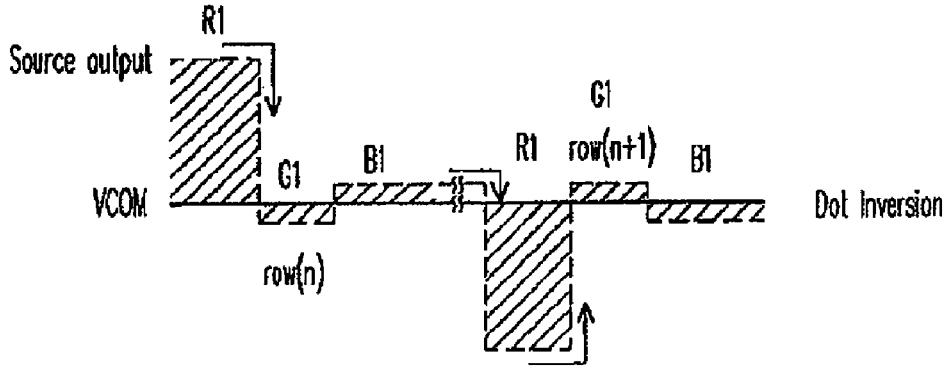
FIG. 4d (PRIOR ART)

In the prior art as shown in FIG. 4*d* under the dot inversion mode, voltage swing occurs when the source output signal of a positive high for driving R1 is changed into source output signal of a negative low for driving G1 and when the source output signal of a negative high for driving R1 is changed into source output signal of a positive low for driving G1.

As discussed above, compared to prior art, the second embodiment of the invention has good performance in low power consumption because voltage swing rates are reduced. In the above embodiments, several sub-pixels in the same color and the same polarity are driven by the same source output signal, and therefore, there are almost no or only small voltage swings in the source output signals. Fewer voltage swing rates result in lower power consumption.

Figure 9:
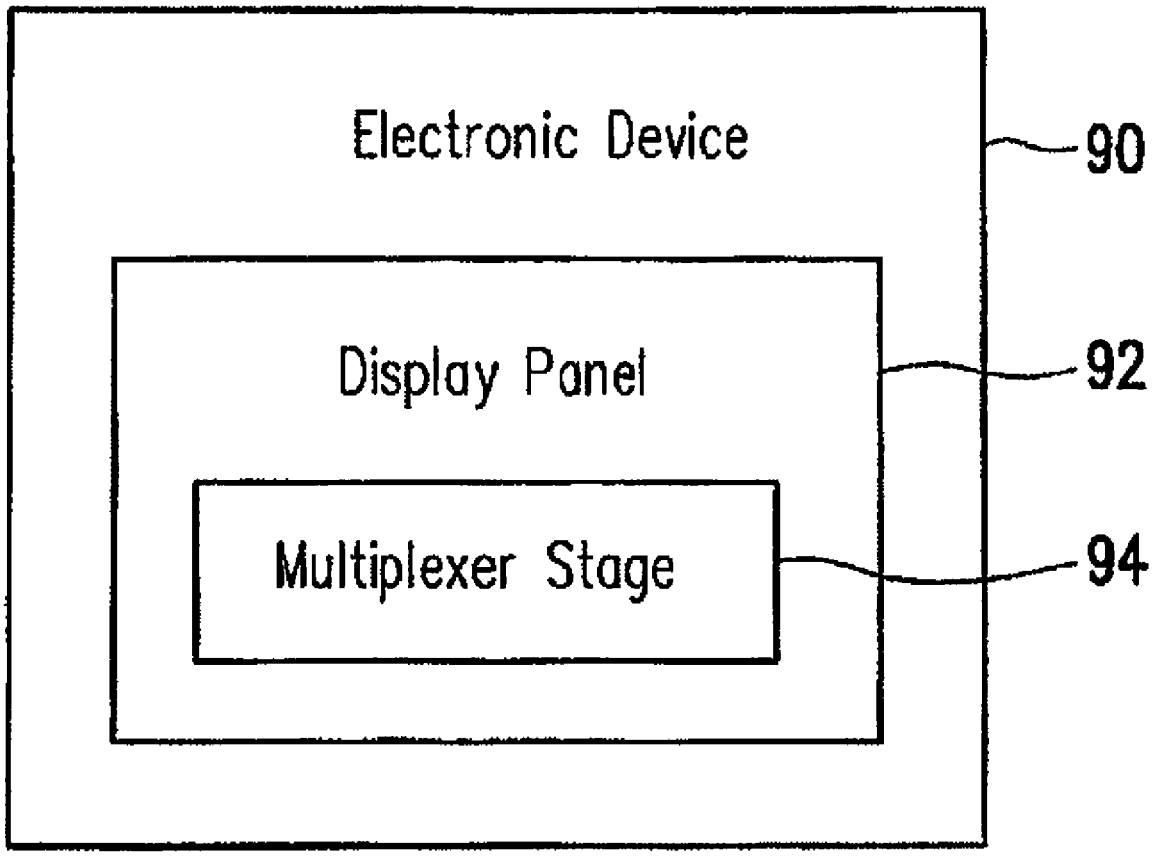
FIG. 9 shows an electronic device according to another embodiment of the invention.

Another embodiment of the invention provides an electronic device. FIG. 9 shows the electronic device according to this embodiment of the invention. The electronic device 90 has a display panel 92 with a multiplexer stage 94. The multiplexer stage 94 has a plurality of multiplexers. These multiplexers have configurations the same or similar to those shown in FIG. 5 and FIG. 7 and the detailed description thereof are omitted for simplicity.

Although the above embodiments are applied in LCD display panel, but the invention are not limited thereby. The invention is also applicable in other flat panel display apparatus. Furthermore, the multiplexers in the above embodiments are 1-to-3 multiplexers, but the invention is not limited thereby. The invention is also applicable to other types of multiplexer, for example 1-to-6 or 1-to-9 multiplexers.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A multiplexer configuration in a display panel for driving a first a second and a third display units of the display panel, the multiplexer configuration comprising:

a source signal line;

a first transistor coupling the source signal line to drive the first display unit under control of a first control signal;

a second transistor coupling the source signal line to drive the second display unit under control of a second control signal; and a third transistor coupling the source signal line to drive the third display unit under control of a third control signal;

wherein conducting periods of the first, second and third transistors are alternative and the first, second and third display units are driven by the source signal line to show the same color in the same scan polarity.

2. The multiplexer configuration of claim 1, wherein the first, second and third display units are red sub-pixels.

3. The multiplexer configuration of claim 1, wherein the first, second and third display units are green sub-pixels.

4. The multiplexer configuration of claim 1, wherein the first, second and third display units are blue sub-pixels.

5. The multiplexer configuration of claim 1, wherein the first transistor comprises a source terminal coupled to the source signal line, a gate terminal coupled to the first control signal and a drain terminal coupled to the first display unit.

6. The multiplexer configuration of claim 1, wherein the second transistor comprises a source terminal coupled to the source signal line, a gate terminal coupled to the second control signal and a drain terminal coupled to the second display unit.

7. The multiplexer configuration of claim 1, wherein the third transistor comprises a source terminal coupled to the source signal line, a gate terminal coupled to the third control signal and a drain terminal coupled to the third display unit.

8. The multiplexer configuration of claim 1, wherein the multiplexer drives the first, second and third display units under a frame inversion mode, a row inversion mode, a column inversion mode or a dot inversion mode.

9. The multiplexer configuration of claim 1, wherein the scan polarity comprises either one of a positive polarity and a negative polarity.

10. A display panel, comprising:

a first, a second and a third display units;

a source signal line;

a multiplexer, comprising:

a first transistor coupling the source signal line to drive the first display unit under control of a first control signal;

a second transistor coupling the source signal line to drive the second display unit under control of a second control signal; and a third transistor coupling the source signal line to drive the third display unit under control of a third control signal;

wherein conducting periods of the first, second and third transistors are alternative and the first, second and third display units are driven by the source signal line to show the same first color in the same scan polarity.

11. The display panel of claim 10, further comprising:

a fourth, a fifth and a sixth display units;

a further source signal line;

a further multiplexer, comprising:

a fourth transistor coupling the further source signal line to drive the fourth display unit under control of the first control signal;

a fifth transistor coupling the further source signal line to drive the fifth display unit under control of the second control signal; and a sixth transistor coupling the further source signal line to drive the sixth display unit under control of the third control signal;

wherein conducting periods of the fourth, fifth and sixth transistors are alternative and the fourth, fifth and sixth display units are driven by the further source signal line to show the same second color in the same scan polarity, the second color being different from the first color.

12. The display panel of claim 10, wherein the first, second and third display units are red sub-pixels, green sub-pixels, or blue sub-pixels.

13. The display panel of claim 11 wherein when the first, second and third display units are blue sub-pixels, the fourth, fifth and sixth display units are red sub-pixels or green sub-pixels;

wherein when the first, second and third display units are red sub-pixels, the fourth, fifth and sixth display units are blue sub-pixels or green sub-pixels; and wherein when the first, second and third display units are green sub-pixels, the fourth, fifth and sixth display units are red sub-pixels or blue sub-pixels.

14. The display panel of claim 10, wherein the scan polarity comprises either one of a positive polarity and a negative polarity.

15. An electronic device, comprising:

a display panel, comprising:

a first, a second and a third display units;

a source signal line;

a multiplexer, comprising:

a first transistor coupling the source signal line to drive the first display unit under control of a first control signal;

a second transistor coupling the source signal line to drive the second display unit under control of a second control signal; and a third transistor coupling the source signal line to drive the third display unit under control of a third control signal;

wherein the conducting periods of the first, second and third transistors are alternative and the first, second and third display units are driven by the source signal line to show the same first color in the same scan polarity.

16. The electronic device of claim 15, wherein the display panel further comprising:

a fourth, a fifth and a sixth display units;

a further source signal line;

a further multiplexer, comprising:

a fourth transistor coupling the further source signal line to drive the fourth display unit under control of the first control signal;

a fifth transistor coupling the further source signal line to drive the fifth display unit under control of the second control signal; and a sixth transistor coupling the further source signal line to drive the sixth display unit under control of the third control signal;

wherein conducting periods of the fourth, fifth and sixth transistors are alternative and the fourth, fifth and sixth display units are driven by the further source signal line to show the same second color in the same scan polarity, the second color being different from the first color.

17. The electronic device of claim 15, wherein the first, second and third display units are red sub-pixels, green sub-pixels, or blue sub-pixels.

18. The electronic device of claim 16, wherein when the first, second and third display units are blue sub-pixels, the fourth, fifth and sixth display units are red sub-pixels or preen sub-pixels;

wherein when the first, second and third display units are red sub-pixels, the fourth, fifth and sixth display units are blue sub-pixels or preen sub-pixels; and wherein when the first, second and third display units are preen sub-pixels, the fourth, fifth and sixth display units are red sub-pixels or blue sub-pixels.

19. The electronic device of claim 15, wherein the scan polarity comprises either one of a positive polarity and a negative polarity.

* * * * *